United States Patent [19]

Gabbard et al.

[11] Patent Number: 4,597,626

[45] Date of Patent: Jul. 1, 1986

[54] KEY BLOCK ARRANGEMENT

[76] Inventors: Larry J. Gabbard, 11555 W. 78th Dr., Arvada, Colo. 80005; Henry J. Gorenz, Jr., 7060 N. Eldridge Ct., Arvada, Colo. 80004

[21] Appl. No.: 654,887

[22] Filed: Sep. 27, 1984

[51] Int. Cl.[4] ..... H01R 13/64

[52] U.S. Cl. ..... 339/184 M; 339/17 M

[58] Field of Search ..... 339/184 R, 184 M, 186 R, 339/186 M, 17 M, 17 LM, 17 LC, 17 R; 361/41 S

[56] References Cited

U.S. PATENT DOCUMENTS

| | | | |
|---|---|---|---|
| 3,166,372 | 1/1965 | Just | 339/186 M |
| 3,404,362 | 10/1968 | Amendola | 339/17 |
| 3,963,301 | 6/1976 | Stark | 339/186 M |
| 4,398,779 | 8/1983 | Ling | 339/17 LC |

*Primary Examiner*—Gil Weidenfeld
*Assistant Examiner*—Thomas M. Kline

[57] ABSTRACT

The subject key block arrangement eliminates the need for modifying connectors or circuit boards and functions to prevent a connector having a width greater than a predetermined size from being inserted into certain positions in the circuit pack carrier. This is accomplished by an L-shaped key block which is attached to the backplane of the carrier. The upright portion of the key block in combination with the existing card guides on the carrier present a predefined aperture into which only connectors of a matching size will fit. Connectors of greater width are blocked from being inserted into connector positions equipped with the key block. Thus, standard connectors, circuit boards and carriers can be used without modification. The key block is inexpensive to manufacture and requires only minimum labor to install in an existing carrier.

6 Claims, 3 Drawing Figures

KEY BLOCK ARRANGEMENT

FIELD OF THE INVENTION

This invention relates to printed circuit board connector arrangements, and in particular, to a key block which prevents the insertion of connectors larger than a predetermined size in a particular position in a circuit board carrier.

BACKGROUND OF THE INVENTION

There are numerous connector keying arrangements which permit the insertion of a circuit board into only a predefined connector. These connector keying arrangements rely on apparatus configurations which are unique for each circuit board/control combination and which apparatus requires the modification of both the circuit board and the connector. An example of this type of connector keying arrangement is illustrated in U.S. Pat. No. 3,404,362 issued Oct. 1, 1968 to D. Amendola. The Amendola patent describes selective indexing apparatus comprising an index bracket which is attached to the circuit board and a corresponding index guide which is attached to the connector. Coding pins are attached to each connector index guide and corresponding holes are drilled through the index bracket of the associated circuit board so that only the particular circuit board can be inserted into the corresponding connector. All other circuit boards will be blocked from insertion into the connector by the index pins on the index guide not mating with corresponding holes on the index bracket of the circuit board.

DESCRIPTION OF THE INVENTION

The difficulty with these prior art connector keying arrangements is that each connector and each circuit board must be modified to implement the connector keying arrangement. This becomes a costly prospect when the number of circuit boards requiring keying is small. The cost of manufacturing a specific code of board and connector for this situation is expensive as is manually modifying standard boards and connectors to realize such a keying arrangement.

The subject key block arrangement eliminates the need for modifying connectors or circuit boards and functions to prevent a connector having a width greater than a predetermined size from being inserted into certain positions in the circuit pack carrier. This is accomplished by an L-shaped key block which is attached to the backplane of the carrier. The upright portion of the key block in combination with the existing card guides on the carrier present a predefined aperature into which only connectors of a matching size will fit. Connectors of greater width are blocked from being inserted into connector positions equipped with the key block. Thus, standard connectors, circuit boards and carriers can be used without modification. The key block is inexpensive to manufacture and requires only minimum labor to install in an existing carrier.

DESCRIPTION OF THE DRAWING

The subject connector key block finds application in the field of circuit pack carriers. For example, in telephone switching systems a typical circuit pack carrier will contain a number of various types or codes of circuit boards. Four line port circuit packs will be inserted into adjacent circuit pack positions in the carrier followed by a logic circuit pack. The line port circuit pack contains communication leads and extensive transmission circuitry, all of which requires a connector having a pin-out of 100 pins. The adjunct logic circuit pack on the other hand contains control circuitry in LSI form which will typically require a connector having a pin-out of 200 pins. Thus, the logic circuit board will be equipped with a connector double the width of the line port circuit board. A difficulty with this arrangement is that a craftsperson can attempt to insert the logic circuit board in one of the circuit pack carrier positions assigned to a line port circuit board. The connector from the line port circuit board contains pins which carry communication signal voltages such as −48 V and ringing. Signals of this magnitude will destroy the logic on the logic circuit board if this board were to be inserted in the line port circuit board connector. Thus, the subject key block arrangement is used to prevent circuit boards having connectors greater than a predetermined size from being inserted into carrier positions which are equipped with connectors of said predetermined size.

Figure 1:
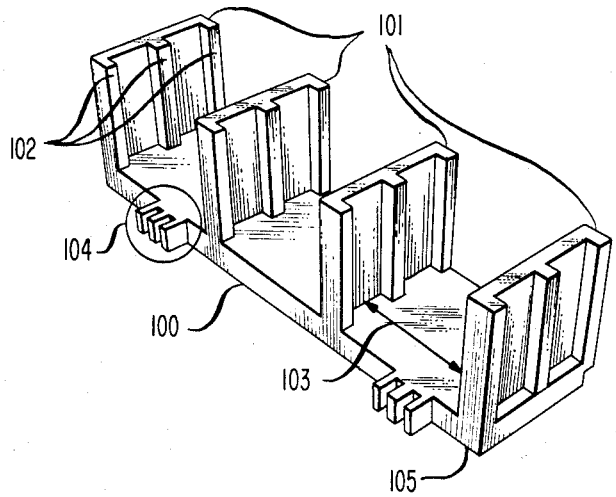
FIG. 1 illustrates a perspective view of a 4-segment key block.
Figure 3:
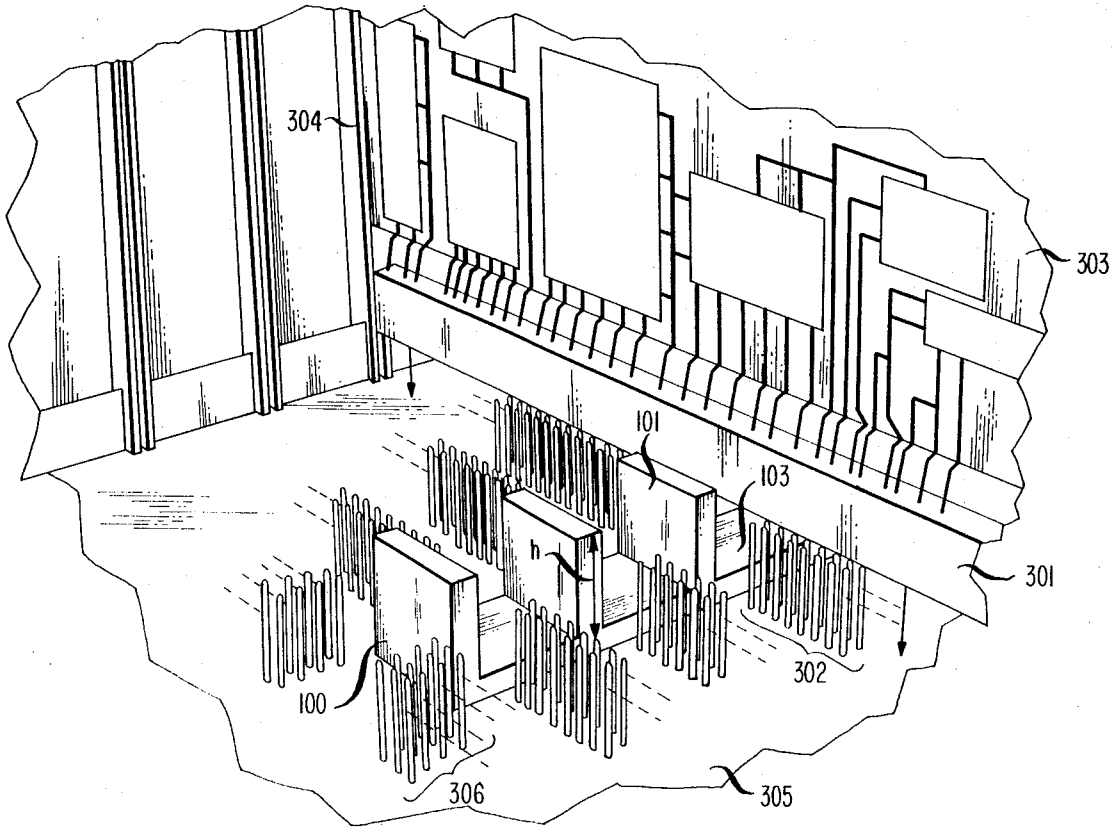
FIG. 3 illustrates a perspective view of a circuit board being inserted into a connector position which is equipped with a key block.

The subject connector key block is illustrated in FIG. 1. The apparatus shown is a 4-segment key block for use with pin-in-hole type of connectors. These pin-in-hole connectors are shown in FIG. 3 where pins 302 protrude in through the backplane wiring 305 of the circuit pack carrier. A circuit board 303 is equipped with a mating connector body 301 which contains a configuration of holes corresponding to the arrangement of pins 302. The circuit pack carrier is equipped with guides 304 which align circuit pack 303 and its associated connector body 301 for proper mating with connector pins 302. For a line port circuit board connector, there would be 100 of pins 302 arranged typically 50 on either side of the midpoint of the circuit board wherein the area around this midpoint will contain no connector pins. These 50 pins illustrated in FIG. 3 are configured in two parallel rows of 25. A logic circuit board would have double the number of pins 306 as illustrated on FIG. 3 with a 100 pins being located on either side of the center point of the connector. This configuration is double the number of rows of pins as for the line port circuit board or four parallel rows or 25 pins on each side of the connector midpoint. It is obvious from the arrangement of pins that a connector body for a 200 pin connector will fit on pins 302 for a 100 pin connector since all the pins are arranged in multiple rows of 25 with uniform spacing. Thus, a logic circuit board can be plugged into a line port circuit board position without difficulty even though the associated connector body is double the width of a line port circuit board.

The connector key block arrangement of FIG. 1 prevents circuit boards equipped with a connector body greater than a predetermined width from being inserted into a connector position equipped with the key block apparatus. The key block of FIG. 1 is basically an L-shaped apparatus comprising a vertical member 101 and a horizontal member 103. Vertical member 101 provides the blocking function as described below and horizontal member 103 provides a manner of attaching the assembly to a backplane as well as providing a structural support for vertical member 101. The key block apparatus shown in FIG. 1 is a four-segment implementation wherein four of the basic L-shaped key blocks are realized in a single piece of apparatus. As can be seen from FIG. 1, the horizontal member (103) of the left most key block of the four-segments illustrated has been eliminated since the support and backplane attachment functions are provided by horizontal member 103 of the adjacent key block.

Figure 2:
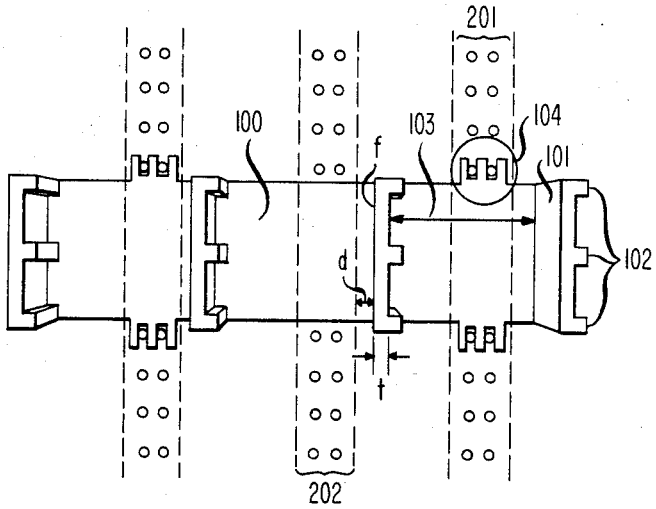
FIG. 2 illustrates a top view of a 4-segment key block, showing the connector position in relation to the key block segments.

Key block 100 can be manufactured from any number of suitable materials and processes, one of which is for example, injection molding of plastic. The thickness of the horizontal leg 103 would be selected to not interfere with the mating of connector body 301 with connector pins 302 yet be thick enough to provide structural support for vertical member 101. The width of horizontal member 103 is determined by the space available between the two sets of pins which comprise the standard connector arrangement. In pin-in-hole connectors, a pinless space is provided around the midpoint of the length of the connector (FIG. 2) for structural integrity. It is into this existing space that the key block apparatus is inserted to provide the connector keying function.

Tab 104 is provided as part of key block 100 for alignment purposes. Each of tabs 104 contain two rectangular slots which align key block 100 on the backplane by fitting around the last two of pins 201 adjacent to the midpoint pinless space of the connector. These rectangular slots automatically provide both vertical and horizontal orientation as can be seen from FIG. 2 without requiring the use of tools or alignment devices.

Each segment of key block 100 includes a vertical member 101. The size and shape of vertical member 101 can be varied significantly and still achieve the purpose of key block 100. The height (Dimension h on FIG. 3) of vertical member 101 must be sufficient that connector body 301 will not come into contact with pins 302. The left most face (f) on FIG. 2 of the vertical member must be of shape and distance (d) from the "foot print" (dotted line 202) of the permitted connector body size so that the permitted connector fits into the aperture created by the connector key block and the circuit pack guides yet all connector bodies of larger size will not come into contact with the connector pins because vertical member 101 obstructs their insertion therein. Vertical member 101 illustrated herein has a flat planer surface for face (f) and is of thickness (t) sufficient to block the insertion of a circuit pack without structural failure. Vertical ribs 102 have been provided on vertical member 101 to minimize the thickness t required yet provide sufficient structurual strength to the key block.

Key block 100 can be attached to backplane wiring 305 by any number of means. One mechanism is to use a mechanical attaching arrangement such as self-tapping screws or bolts. A more economical method is to provide under-side 105 of key block 100 with an adhesive coating so key block 100 can be pressed into position and secured to backplane wiring 305 in one easy step.

While a specific embodiment of the invention has been disclosed, variations in structural detail, within the scope of the appended claims, are possible and are contemplated. There is no intention of limitation to what is contained in the abstract or the exact disclosure as herein presented. The above-described arrangements are only illustrative of the application of the principles of the invention. Normally, other arrangements may be devised by those skilled in the art without departing from the scope and the spirit of the invention.

What is claimed is:

1. in a circuit pack carrier having a back side which consists of backplane wiring having protruding therefrom to the front side a plurality of sets of pins which are the pin elements of pin-in-hole connectors and having top and bottom sides each of which are equipped with a plurality of card guides for aligning with said plurality of sets of pins circuit boards each of which are equipped with a connector body which is the mating segment to one of said sets of pins, a key block apparatus for preventing the insertion of any of said circuit boards equipped with a connector body of greater than a predetermined width onto a designated one of said plurality of sets of pins comprising:

base means attachable to said front side of said backplane for securing said key block to said front side of said backplane in close proximity to said designated set of pins;

block means protruding from said base means in said frontwise direction a distance greater than or equal to the height of said pin elements above said backplane for providing a predetermined aperture between said block means and said designated set of pins for only a connector body of less than said predetermined width to pass through before contacting said designated set of pins; and wherein said base means includes tab means having one or more slots included therein for aligning said key block apparatus on said backplane by inserting associated pins of said connector pins into said slots.

2. In a circuit pack carrier having a back side comprising backplane wiring and having protruding from the surface therefrom in a frontwise direction a plurality of sets of pins which comprise the pin elements of pin-in-hole connectors and having top and bottom sides which are equipped with a plurality of circuit board guides for guiding circuit boards into mating orientation with said sets of pins wherein each of said circuit boards contain a connector body which mates to said pin elements, a key block apparatus for preventing the engagement of any connector bodies which exceed a predetermined width with a designated one of said sets of pins comprising:

base means having an adhesive coated flat surface for attaching said key block to the front side of said backplane in close proximity to said designated set of pins;

block means connected to said base means and protruding a distance greater than or equal to the height of said pins above said front side of said backplane for blocking the insertion of a connector block of greater than a predetermined width onto said designated set of pins; and wherein said base means includes tab means having one or more slots included therein for aligning said key block apparatus on said backplane by inserting associated pins of said connector pins into said slots.

3. The apparatus of claims 1 or 2 wherein said block means includes vertical member means having at least one flat face which is aligned in parallel orientation with said rows of pins for enabling the unobstructed insertion of only a connector block of said predetermined width onto said designated set of pins.

4. The apparatus of claim 3 wherein said block means includes:

support means comprising a plurality of parallel ribs attached to the side of said vertical member means opposite of said one flat face for providing structural strength to said vertical member means.

5. The apparatus of claim 4 wherein said rib means are attached to said vertical member means from said base means along said opposite side in a frontwise direction.

6. In a circuit pack carrier having a back side which consists of backplane wiring having protruding therefrom to the front side a plurality of sets of pins which are the pin elements of pin-in-hole connectors and having top and bottom sides each of which are equipped with a plurality of card guides for aligning with said plurality of sets of pins circuit boards each of which is equipped with a connector body which is the mating segment to one of said sets of pins, a key block apparatus for preventing the insertion of any of said circuit boards equipped with a connector body of greater than a predetermined width onto a designated one of said plurality of sets of pins comprising:

base means having at least one flat face which has an adhesive substance applied thereto for attaching said key block apparatus to said backplane in close proximity to said designated set of pins;

block means connected to said base means and having at least one flat face extending perpendicular to said base means in a frontwise direction, said one face of which is parallel to said designated set of pins for blocking the engagement of all connector bodies of greater than said predetermined width with said designated set of pins; and wherein said base means includes tab means having one or more slots included therein for aligning said key block apparatus on said backplane by inserting associated pins of said connector pins into said slots.

* * * * *